US008479691B1

(12) United States Patent
Taylor et al.

(10) Patent No.: US 8,479,691 B1
(45) Date of Patent: Jul. 9, 2013

(54) METHOD FOR COOLING A FOUR STROKE MARINE ENGINE WITH MULTIPLE PATH COOLANT FLOW THROUGH ITS CYLINDER HEAD

(75) Inventors: Christopher J. Taylor, Fond du Lac, WI (US); Timothy S. Reid, Fond du Lac, WI (US); William J. Towne, Fond du Lac, WI (US); David J. Belter, Oshkosh, WI (US); Gregg D. Langenfeld, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 851 days.

(21) Appl. No.: 12/468,452

(22) Filed: May 19, 2009

(51) Int. Cl.
*F01P 3/20* (2006.01)

(52) U.S. Cl.
USPC ..... 123/41.29; 123/41.72; 123/41.74; 123/41.79; 123/41.82 R; 440/88 C; 440/88 G; 440/88 J; 440/88 M

(58) Field of Classification Search
USPC ..... 123/41.29, 41.33, 41.79, 41.74, 41.82 R; 440/88 C, 88 G, 88 J, 88 M
See application file for complete search history.

(56) References Cited

U.S. PATENT DOCUMENTS 3,358,654 A * 12/1967 Shanahan et al. ..... 123/41.08
5,036,804 A 8/1991 Shibata
5,048,467 A 9/1991 Kojima
5,452,866 A 9/1995 Bulman
5,752,866 A 5/1998 Takahashi et al.
5,873,330 A 2/1999 Takahashi et al.
5,893,783 A 4/1999 Hiraoka et al.
5,904,605 A 5/1999 Kawasaki et al.
5,916,135 A * 6/1999 Yoshida et al. ..... 60/302
5,975,032 A 11/1999 Iwata
5,980,340 A * 11/1999 Okamoto ..... 440/88 L
6,071,159 A 6/2000 Watanabe et al.
6,135,833 A * 10/2000 Tsunoda ..... 440/88 C
6,276,327 B1 * 8/2001 Fukuoka et al. ..... 123/196 W
6,471,559 B2 * 10/2002 Kashima ..... 440/88 G
6,513,463 B2 * 2/2003 Katayama ..... 123/41.29
6,758,173 B2 * 7/2004 Saito et al. ..... 123/41.74
6,890,228 B2 5/2005 Tawa et al.
6,921,306 B2 7/2005 Tawa et al.
6,976,892 B2 12/2005 Tawa et al.
7,069,882 B2 * 7/2006 Yonezawa et al. ..... 123/41.72
7,114,469 B1 10/2006 Taylor
7,264,520 B1 * 9/2007 Taylor et al. ..... 440/88 HE
7,318,396 B1 * 1/2008 Belter et al. ..... 123/41.8
2002/0069912 A1 6/2002 Prentice (Continued)

FOREIGN PATENT DOCUMENTS

JP 07317597 A * 12/1995

*Primary Examiner* — Noah Kamen
*Assistant Examiner* — Grant Moubry
(74) *Attorney, Agent, or Firm* — Andrus, Sceales, Starke & Sawall, LLP

(57) ABSTRACT

A cooling system for a marine engine is provided with various cooling channels which allow the advantageous removal of heat at different rates from different portions of the engine. A split flow of water is conducted through the cylinder head, in opposite directions, to individually cool the exhaust port and intake ports at different rates. This increases the velocity of coolant flow in the downward direction through the cylinder head to avoid the accumulation of air bubbles and the formation of air pockets that could otherwise cause hot spots within the cylinder head. A parallel coolant path is provided so that a certain quantity of water can bypass the engine block and avoid overcooling the cylinder walls.

15 Claims, 10 Drawing Sheets

U.S. PATENT DOCUMENTS

2002/0166518 A1 11/2002 Osakabe
2005/0042949 A1 2/2005 Tawa et al.
2005/0229874 A1* 10/2005 Yonezawa et al. ..... 123/41.74
2006/0254272 A1 11/2006 Petutsching et al.
2009/0130928 A1* 5/2009 Taylor et al. ..... 440/88 M

* cited by examiner

METHOD FOR COOLING A FOUR STROKE MARINE ENGINE WITH MULTIPLE PATH COOLANT FLOW THROUGH ITS CYLINDER HEAD

CROSS REFERENCE TO RELATED APPLICATIONS

The present application is related to patent application Ser. No. 12/468,412 which was filed on the same date as the present application.

BACKGROUND OF THE INVENTION

1. Field of the Invention

The present invention is generally related to a method for cooling a marine engine and, more particularly, to a method for directing coolant through a multiple pass path through its cylinder head.

2. Description of the Related Art

Those skilled in the art of marine engines are familiar with many different types of cooling systems and many different techniques for removing heat from various heat emitting components of marine propulsion systems. Those skilled artisans are also familiar with many important issues associated with the removal of heat from marine engines. Not only is it important to avoid the overheating of various components and devices of a marine propulsion system, but it is also very important to avoid the removal of too much heat from certain portions of the engine. This is particularly true in marine engines, as opposed to engines used to propel land vehicles, because marine engines often use water from a body of water as its primary coolant and the water taken from lakes, rivers, bays, and oceans are often significantly colder than is desirable for maintaining the best operating temperatures of certain engine components. The use of cold water can often result in the overcooling of certain portions of the engine and, as a result, the condensing of fuel vapor which can dilute the oil supply of the engine with liquid fuel. The disadvantages of oil dilution are well known to those skilled in the art of marine engines as are the various types of damage that can result from it. Other problems associated with cooling marine engines relate to the direction of cooling water as it flows through engine components. Those skilled in the art of marine engines are also familiar with the importance of the sequence with which various engine components are cooled.

U.S. Pat. No. 5,036,804, which issued to Shibata on Aug. 6, 1991, describes a cooling system for a four stroke outboard motor. The cooling system for a four cycle internal combustion engine utilized as a power plant for an outboard motor is described. The cooling system is designed so that coolant is first delivered to cool an exhaust manifold in the cylinder block, then the exhaust port of the cylinder head and the other cylinder head components and then the cylinder block cooling jacket surrounding the cylinder bores.

U.S. Pat. No. 5,048,467, which issued to Kojima on Sep. 17, 1991, describes a water jacket arrangement for marine two cycle internal combustion engines. An outboard motor having an improved cooling system, wherein liquid coolant is circulated through an exhaust manifold cooling jacket then through a cylinder head cooling jacket and then through an upper portion of the cylinder block cooling jacket, is described. A thermostatic valve controls the flow from the upper cylinder block cooling jacket through a lower cylinder block cooling jacket so as to avoid quenching of the intake charge by coolant which has not reached operating temperature.

U.S. Pat. No. 5,873,330, which issued to Takahashi et al. on Feb. 23, 1999, describes a cooling arrangement for an engine. A cooling system for a vertically oriented engine of an outboard motor is disclosed. Coolant flows through the coolant system from a coolant pump into a coolant jacket surrounding an exhaust manifold of the engine, down to a bottom of a cylinder head of the engine, through a cylinder head, an engine block, through a thermostat, and then to a jacket positioned along an exhaust pipe leading from the exhaust manifold, to a coolant discharge.

U.S. Pat. No. 5,904,605, which issued to Kawasaki et al. on May 18, 1999, describes a cooling apparatus for an outboard motor. The outboard motor is provided with a water cooled engine in a vertical alignment in which a crankshaft is vertically disposed, the engine being composed of a cylinder block, a cylinder head and an exhaust manifold into which water jackets are formed respectively and the water jackets are supplied with cooling water from a water pump disposed below the engine, the cooling apparatus comprising a cylinder cooling water passage for supplying cooling water from the water pump to the water jackets of the cylinder block and the cylinder head. It also comprises an exhaust cooling water passage for supplying cooling water from the water pump to the water jacket of the exhaust manifold, the cylinder cooling water passage and the exhaust cooling water passage being independently disposed from each other and being joined together at downstream portions thereof.

U.S. Pat. No. 6,890,228, which issued to Tawa et al. on May 10, 2005, describes an outboard motor equipped with a water cooled engine. It includes an exhaust manifold cooling water jacket for cooling an exhaust manifold for discharging to the outside exhaust gas from a combustion chamber. The manifold cooling water jacket is supplied with cooling water from a cooling water pump. A water outlet is provided in the highest part of the exhaust manifold cooling water jacket and is made to communicate with a water check outlet for confirming the circulation of cooling water due to operation of the cooling water pump.

U.S. Pat. No. 6,921,306, which issued to Tawa et al. on Jul. 26, 2005, describes a water cooled vertical engine and outboard motor equipped therewith. It includes an exhaust guide cooling water jacket and an exhaust manifold cooling water jacket which are formed in an engine compartment. It also comprises a cylinder block cooling water jacket formed in a cylinder block. Water is supplied from a cooling water pump in parallel to an upper part and a lower part of the cylinder block cooling water jacket through the exhaust guide cooling water jacket and the exhaust manifold cooling water jacket.

U.S. Pat. No. 7,114,469, which issued to Taylor on Oct. 3, 2006, discloses a cooling system for a marine propulsion engine. The system divides a flow of cooling water into first and second streams downstream of a pump. The first stream flows through a first cooling system which is controlled by a pressure sensitive valve. The second stream flows through a second cooling system which is controlled by a temperature sensitive valve.

U.S. Pat. No. 7,264,520, which issued to Taylor et al. on Sep. 4, 2007, discloses a cooling system for an outboard motor having both open and closed loop portions. The system pumps water from a body of water through certain selected portions of the outboard motor and through a heat exchanger which, in turn, comprises a coolant conduit that is directed to conduct the coolant in thermal communication with various portions of the outboard motor. The engine block is cooled by a flow of the coolant and an engine head is cooled by a flow of water from the body of water. Other head emitting devices are connected in thermal and fluid communication with the water and coolant conduits.

U.S. Pat. No. 7,318,396, which issued to Belter et al. on Jan. 15, 2008, discloses a cooling system for a marine propulsion engine. It incorporates first and second thermally responsive valves which are responsive to increases in temperature above first and second temperature thresholds, respectively. The two thermally responsive valves are configured in serial fluid communication with each other in a cooling system, with one thermally responsive valve being located upstream from the other.

The patents described above are hereby expressly incorporated by reference in the description of the present invention.

It would be beneficial if a cooling system for a marine engine could remove heat from selected portions of the engine system sequentially in a preferred order that prevents overcooling of certain components while assuring that sufficient heat is removed from other components. In addition, it would be beneficial if this type of cooling system could avoid the entrapment of air pockets within the coolant flow that could otherwise result in the overheating of local regions of the engine system. In addition, it would be beneficial if various portions of the engine could be cooled in a manner that tailors the amount of heat removed from various regions of the engine by governing the magnitude of coolant flow in a preselected proportion that is selected as a function of the type of engine and the relative heat emitted by the various regions of the engine.

SUMMARY OF THE INVENTION

A method for cooling an engine of a marine propulsion system, in accordance with a preferred embodiment of the present invention, comprises the steps of pumping a first stream of water from a body of water in which the marine propulsion system is operating, directing the first stream of water through a cooling jacket of an exhaust manifold, directing second and third streams of water through a head of the engine, directing a fourth stream of the water through a block of the engine, directing a fifth stream of water out of and away from the block of the engine and, in certain embodiments of the present invention, conducting a sixth stream of the water away from the exhaust manifold of the engine and preventing the sixth stream of the water from further flowing into the head of the engine wherein the first stream of the water is greater than the second stream of the water. In certain embodiments of the present invention, water is directed to flow in two opposing directions through the cylinder head of the engine. In certain embodiments of the present invention, water is directed to flow away from the engine, from a point sequentially between the exhaust manifold and the cylinder head, in order to remove heat from the exhaust manifold without allowing that heat to raise the temperature of other portions of the engine. In particularly preferred embodiments of the present invention, cooling water is directed to flow to downwardly through a cooling jacket of the cylinder head that is disposed in thermal communication with exhaust ports of the engine and then a portion of that cooling water is directed to flow upwardly in thermal communication with intake ports of the cylinder head. In certain alternative embodiments of the present invention, the cooling water, after flowing downwardly in thermal communication with the exhaust ports of the head of the engine, is directed to flow through a fluid conducting portion of the engine which might not be a portion of the cylinder head. Although, in certain preferred embodiments of the present invention, the fluid conducting portion of the engine comprises a second portion of the cylinder head, the fluid conducting portion of the engine can alternatively comprise a main oil gallery water jacket, cooling channels in the bed plate of the engine, the combustion chambers within the cylinder head, or simply a water conduit that directs this portion of the coolant flow to or through the engine block and eventually through a thermostat. Some of the cooling water is directed to flow in thermal communication with the cylinder walls in the engine block after flowing through the cylinder head. A temperature responsive valve controls the flow of water through the engine in preferred embodiments of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
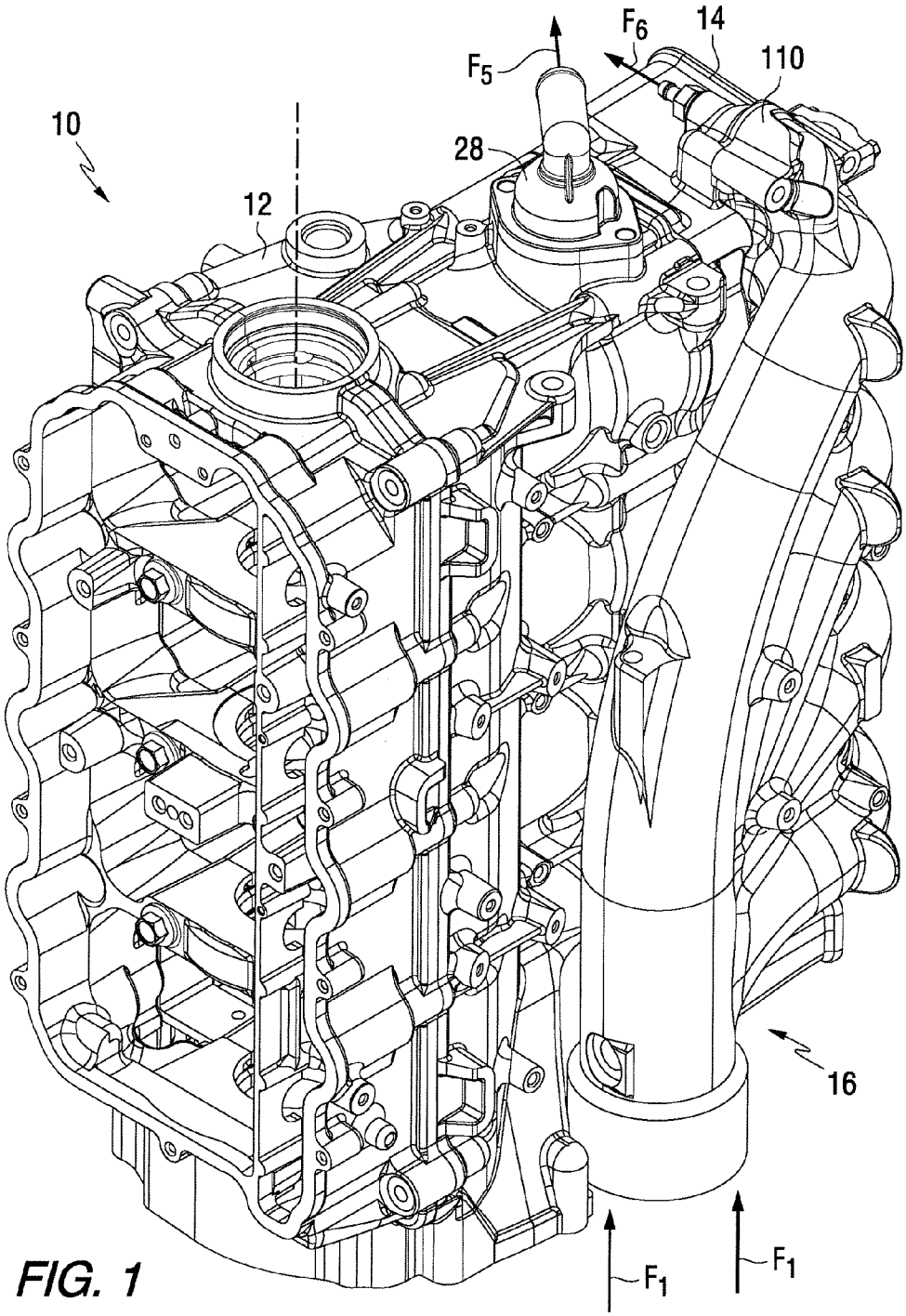
FIG. 1 is an isometric view of an engine made in accordance with a preferred embodiment of the present invention.

Throughout the description of the preferred embodiment of the present invention, like components will be identified by like reference numerals.

Figure 2:
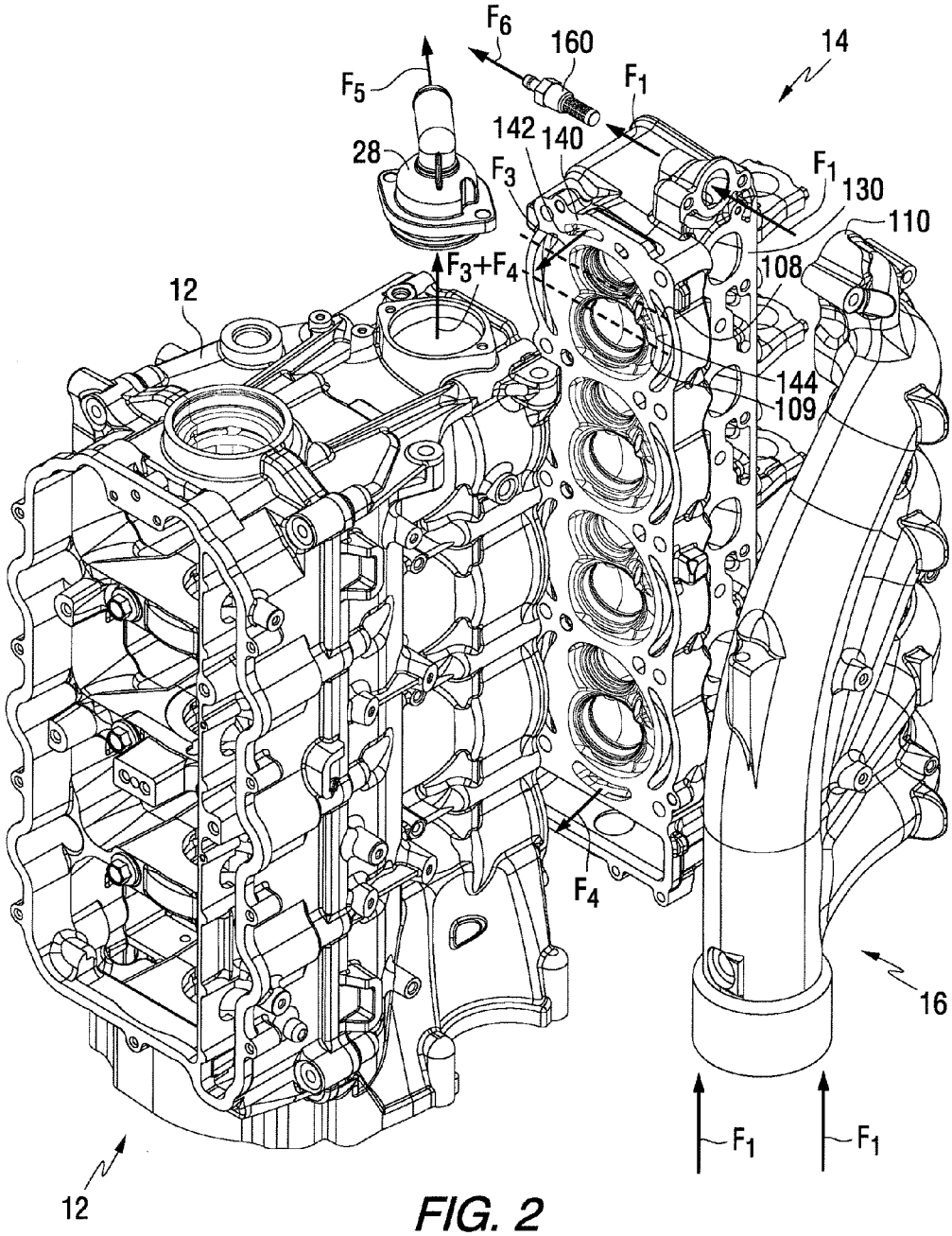
FIG. 2 is an exploded isometric view of the engine illustrated in FIG. 1.
Figure 3:
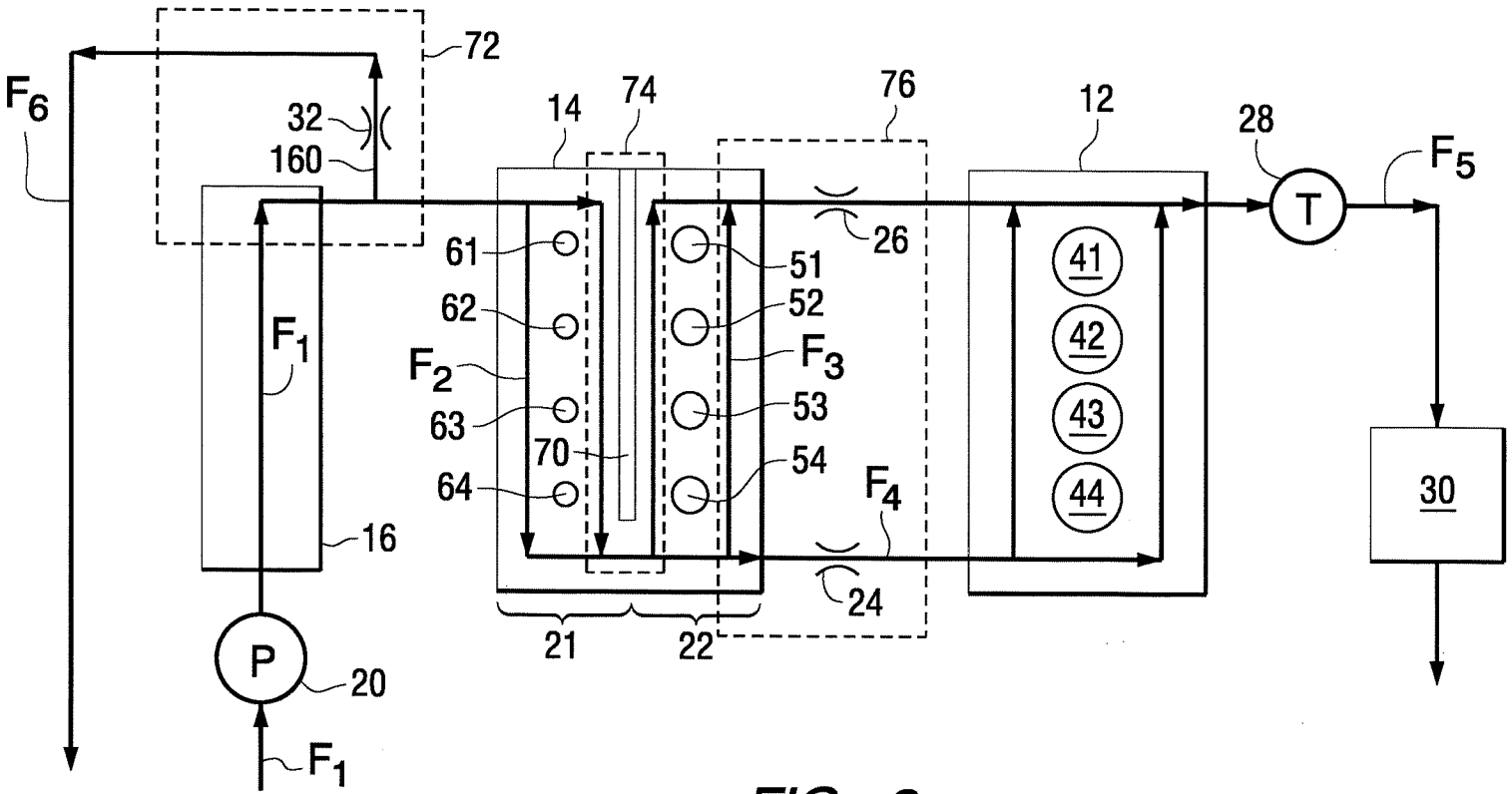
FIG. 3 is a simplified schematic representation of an engine cooling system.
Figure 4:
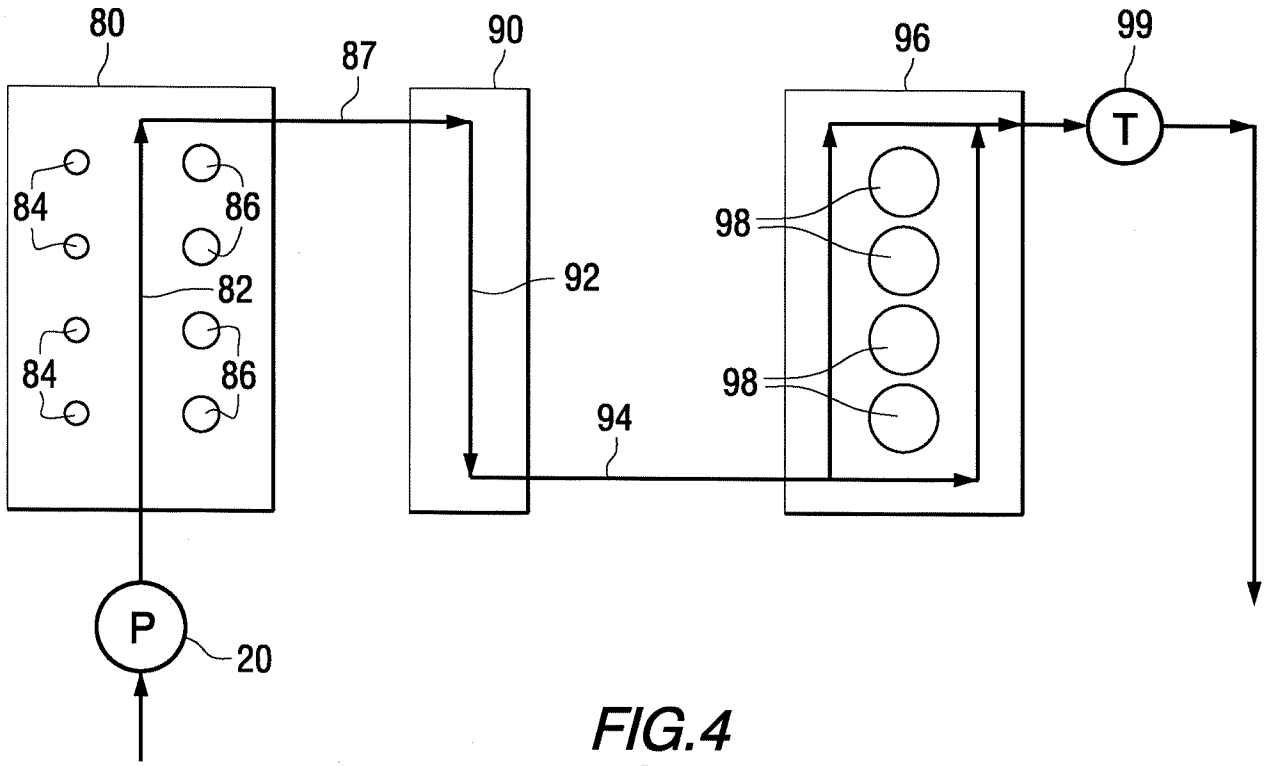
FIG.4 PRIOR ART
FIGS. 4-6 are simplified schematic representations of known types of engine cooling systems.
Figure 5:
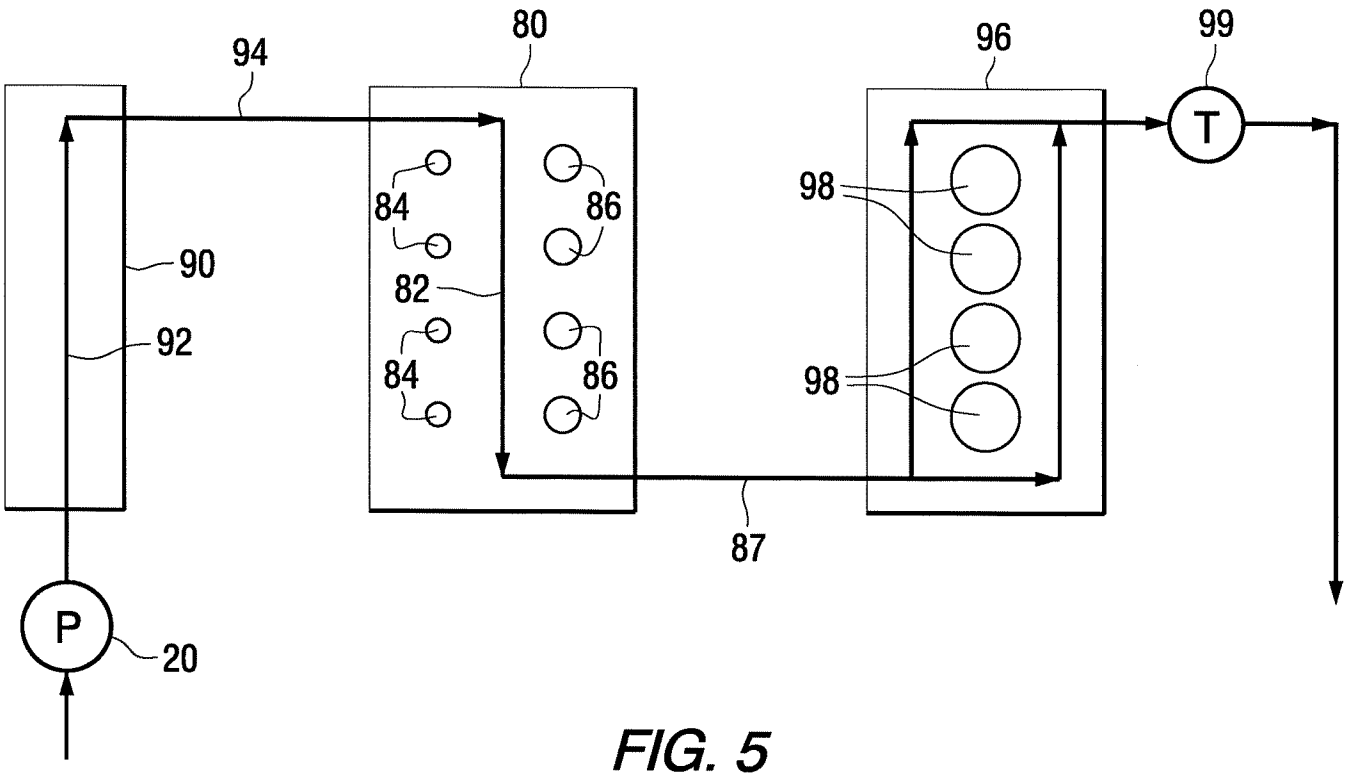
FIG. 5 PRIOR ART
Figure 6:
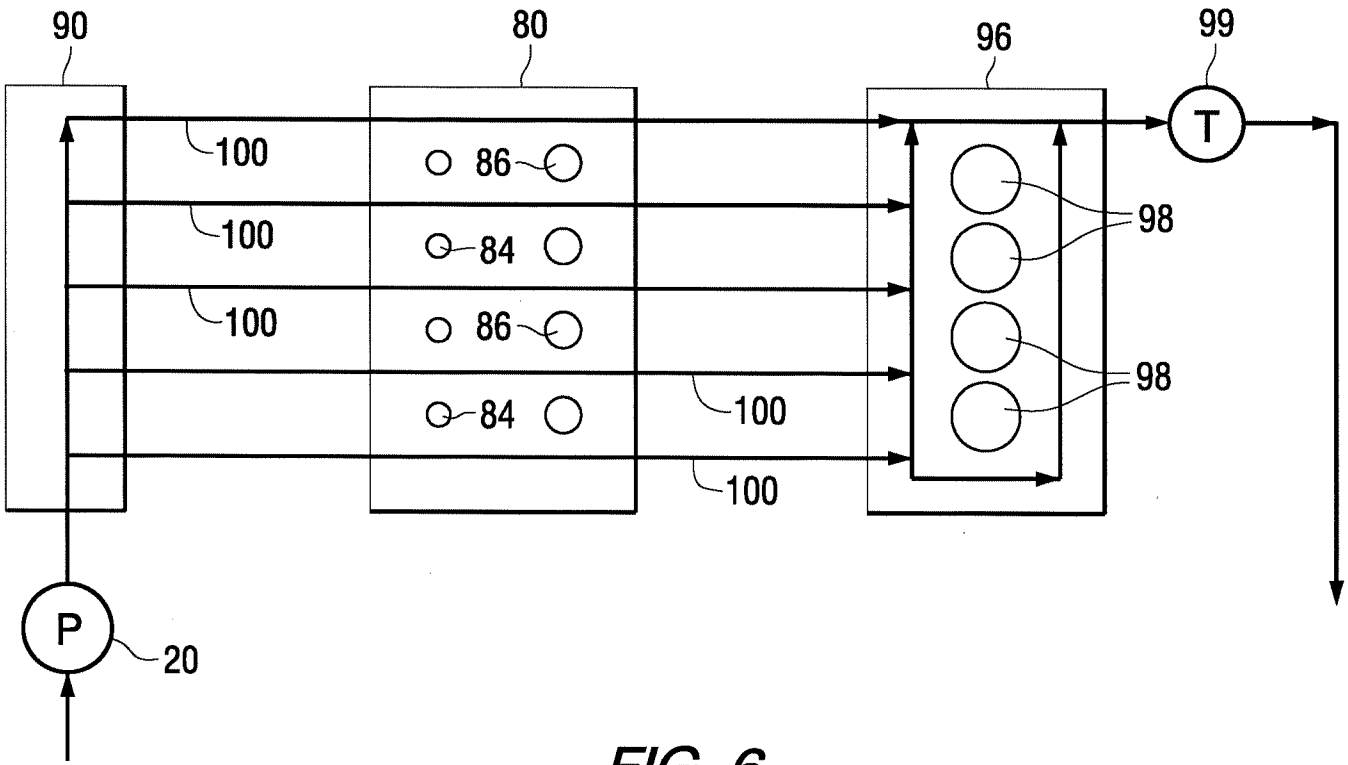
FIG. 6 PRIOR ART
Figure 7:
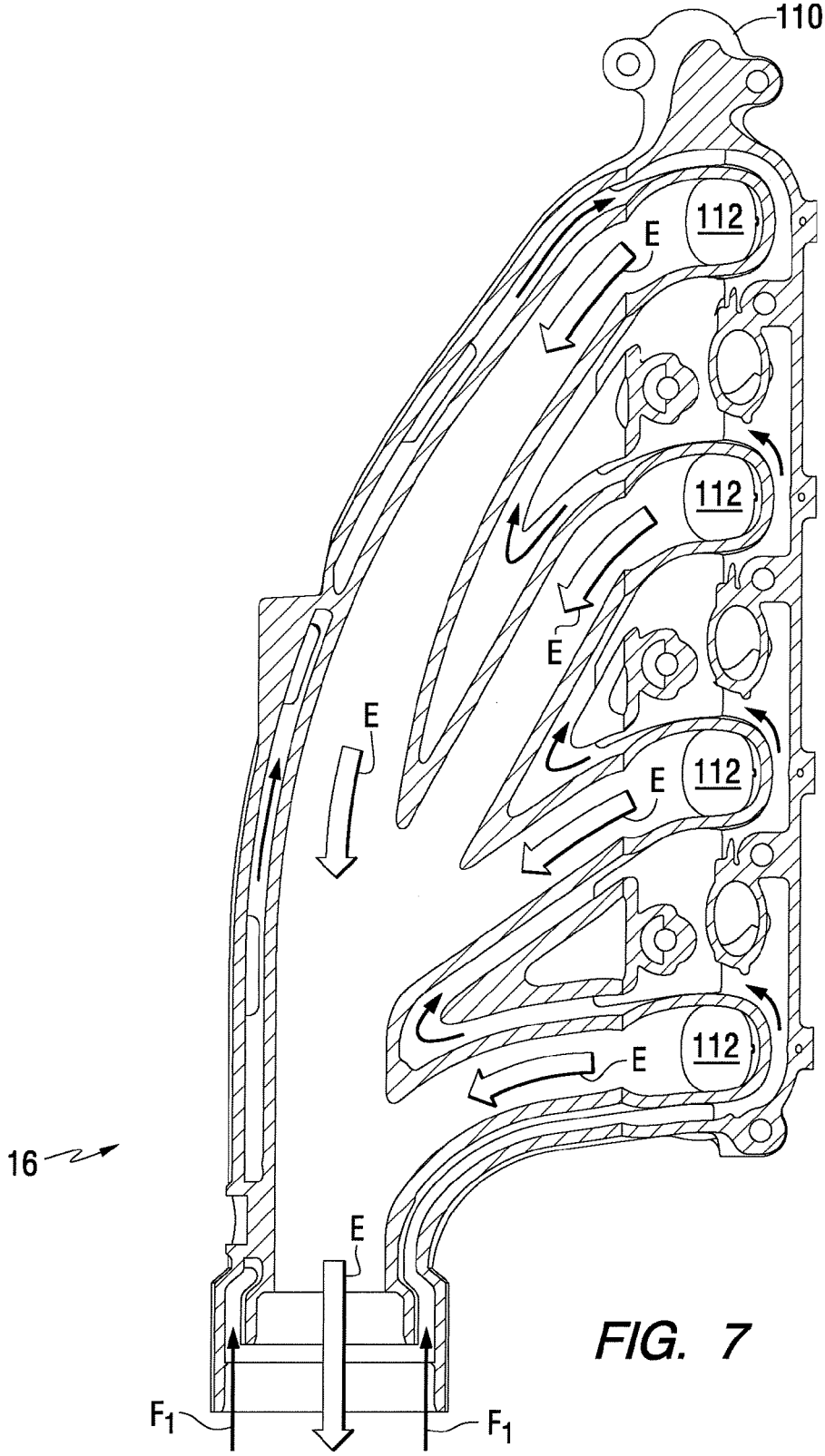
FIG. 7 is a section view of an exhaust manifold.
Figure 8:
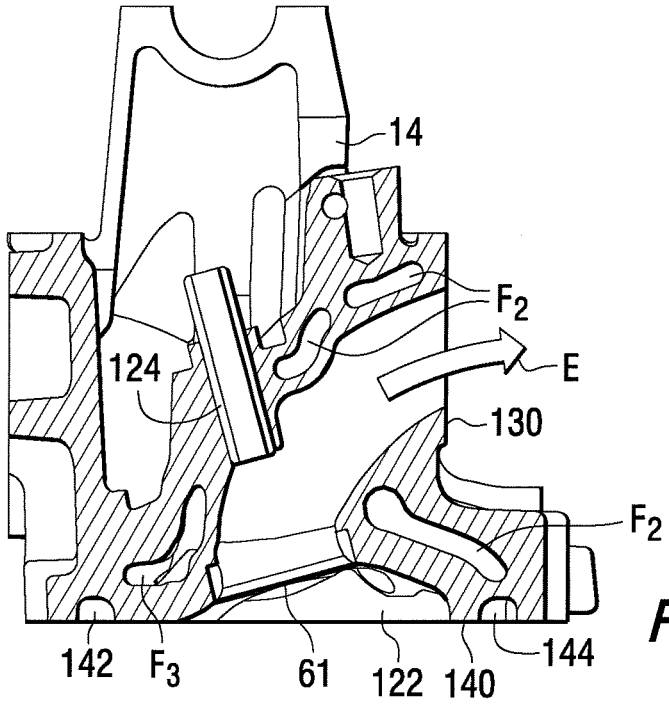
FIG. 8 is a section view of a cylinder head taken through an exhaust port.
Figure 9:
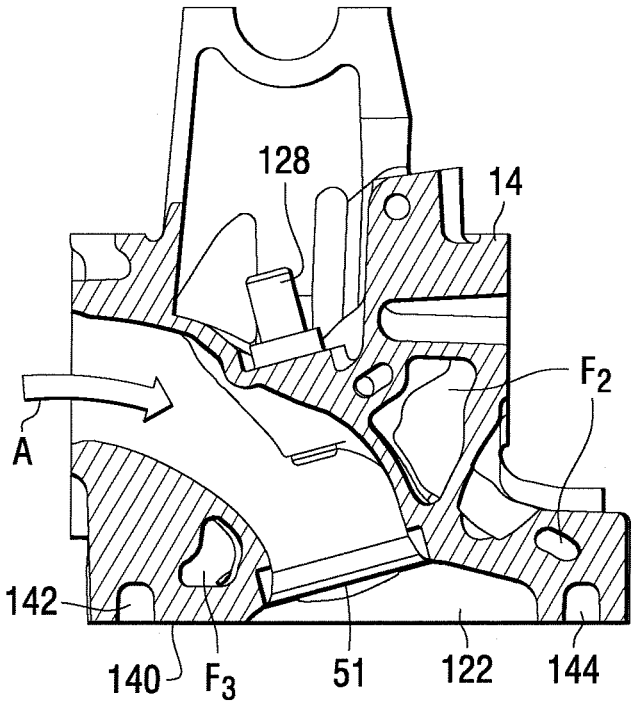
FIG. 9 is a section view of a cylinder head taken through an intake port.
Figure 10:
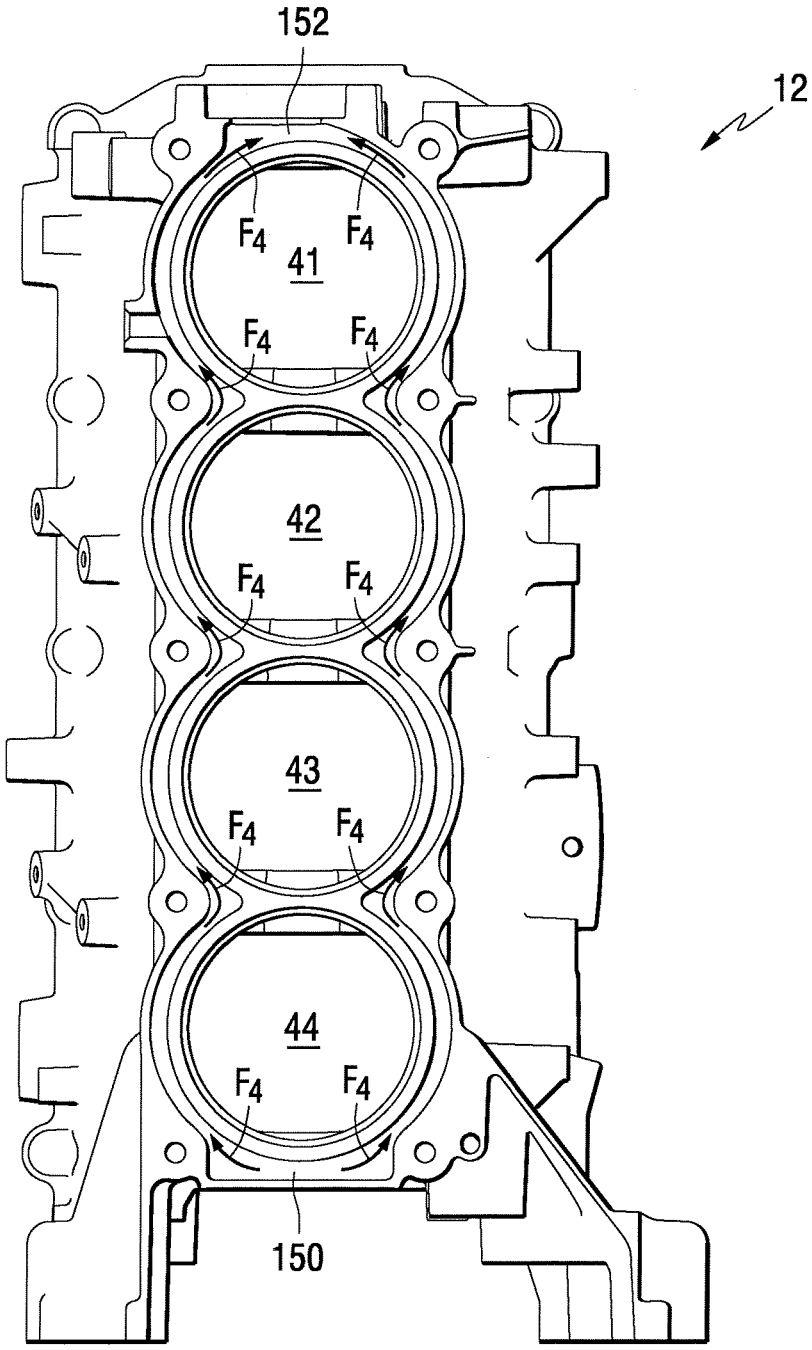
FIG. 10 is an end view of the engine block.
Figure 11:
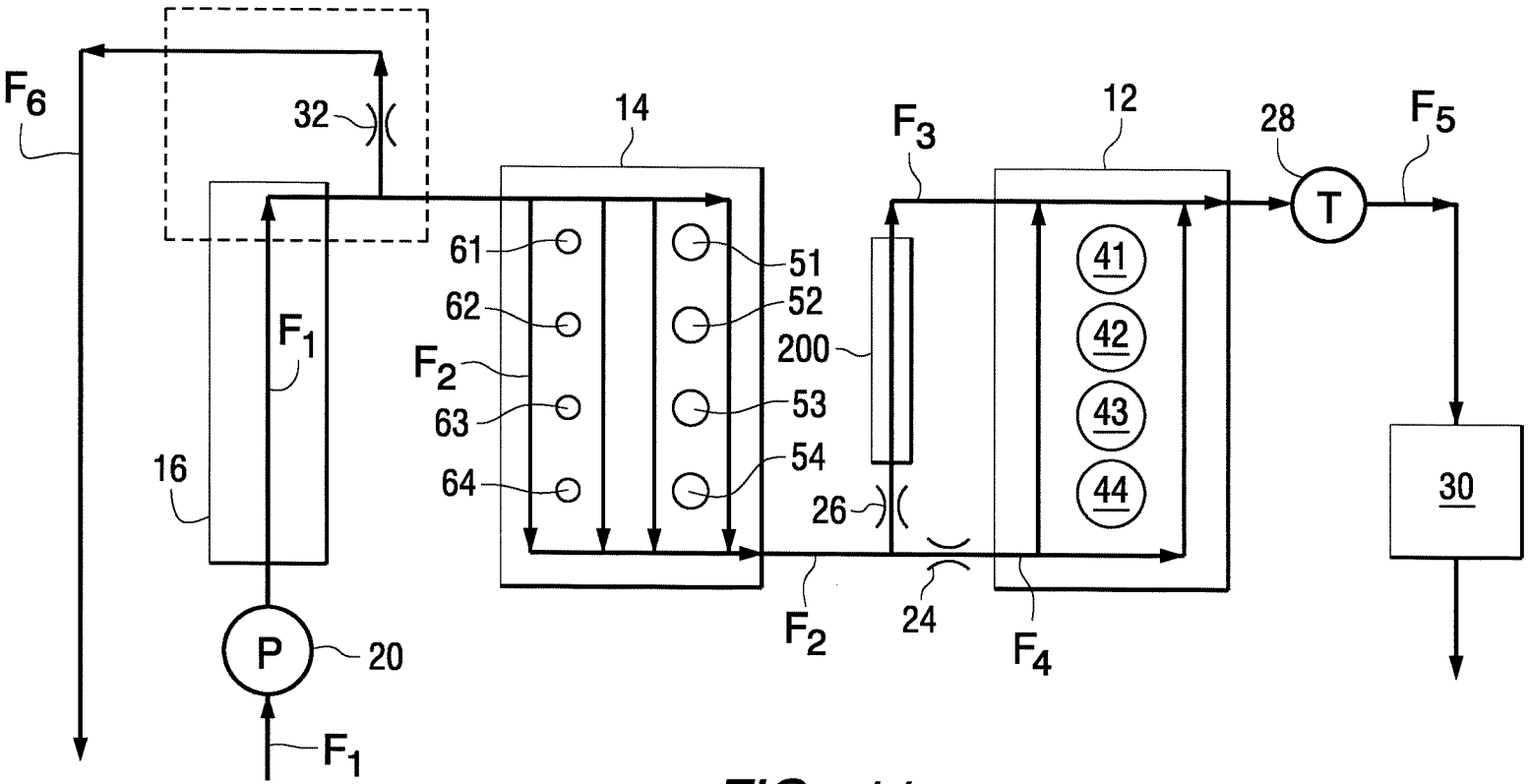
FIG. 11 is a simplified illustration of an alternative embodiment of the present invention.

In conjunction with the following description of the various embodiments of the present invention, FIG. 1 is an isometric view of a marine engine. FIG. 2 is an exploded isometric view of the marine engine shown in FIG. 1 and shows the block 12 of the engine separated from the cylinder head 14 and exhaust manifold 16 of the engine. FIG. 3 is a highly simplified schematic representation of a marine engine system which is generally similar to the engine illustrated in FIGS. 1 and 2 and configured to comprise various preferred embodiments of the present invention. FIGS. 4-6 illustrate various marine engine configurations that are known to those skilled in the art. These known engine configurations will be described below in order to more clearly illustrate certain characteristics and features of the preferred embodiments of the present invention. FIG. 7 is a section view of the exhaust manifold 16 of a preferred embodiment of the present invention. FIGS. 8 and 9 are section views taken through selected planes of the cylinder head 14 illustrated in FIG. 2 and FIG. 10 is a view of the block of the engine 10 showing the cooling jacket that surrounds the cylinders of the engine. FIGS. 1-10 will be described below in the description of the preferred embodiments of the present invention and in conjunction with a description of various known types of marine engines. FIG. 11 is a schematic illustration of an alternative embodiment of the present invention.

With reference to FIGS. 1-3, FIG. 3 is a highly simplified schematic is representation of the engine illustrated in the isometric views of FIGS. 1 and 2 and is provided to help to describe the basic flow of streams of water through the portions of the engine. With particular reference to FIG. 3, a pump 20 draws a first stream of water $F_1$ from a body of water in which a marine propulsion system is operated. The first stream $F_1$ is directed upwardly through a cooling jacket of the exhaust manifold 16 of the engine. A second stream of water $F_2$ is directed through a first portion 21 of the head 14 of the engine. A third stream of water $F_3$ is directed through a second portion 22 of the head 14 of the engine. In certain alternative embodiments of the present invention, the third stream of water can be directed through a fluid conducting portion of the engine which is not a second portion 22 of the cylinder head 14. Alternatively, the fluid conducting portion of the engine can be a main oil gallery water jacket, a bed plate cooling passage, the combustion chambers, or simply a conduit that directs the third stream of water to other cooling jackets or directly to a thermostat for eventual return of this water to the body of water. FIG. 11 illustrates this alternative embodiment of the present invention. It can be seen that FIG. 11 is generally similar to FIG. 3, but with a simpler cooling path through the cylinder head 14 and with an additional fluid conducting portion 200 illustrated immediately to the left of the engine block 12.

The two orifices, 24 and 26, determine the ratio of the third and fourth streams of water, $F_3$ and $F_4$, as described above. However, the third stream of water does not flow upwardly through the cylinder head 14 as described above in conjunction with FIG. 3. Instead, it flows through the fluid conducting portion 200 which, as described above, can be a simple conduit such as a hose, a main oil gallery cooling jacket, a bed plate cooling jacket, a combustion chamber cooling jacket, or any other conduit that directs the third stream of water $F_3$ from the cylinder head 14 to the thermostat 28, whether it passes through a portion of the engine block 12 or not. A fourth stream of water $F_4$ is directed through a block 12 of the engine. The relative magnitude of the third and fourth streams of water, $F_3$ and $F_4$, are determined by the orifices, 24 and 26, provided in the conduits which conduct the third and fourth streams from the cylinder head 14 to the block 12 as shown in FIG. 3. A temperature responsive valve 28, or thermostat, governs the flow of the fifth stream of water $F_5$ which conducts the coolant away from the engine and, in certain embodiments of the present invention, in thermal communication with an oil sump 30. As a result, the water flowing in thermal communication with the oil sump 30 is maintained at a temperature equal to or greater than the temperature to which the thermostat 28 is responsive.

With continued reference to FIGS. 1-3, several characteristics of the cooling system can be seen. For example, the flow rate of the second stream of water $F_2$ is equal to the sum of the flow rates of the third and fourth streams of water, $F_3$ and $F_4$. Furthermore, the flow rate of the fifth stream of water $F_5$ is generally equal to the flow rate of the second rate of water $F_2$. The relative rate of flow of the third and fourth streams of water, $F_3$ and $F_4$, are governed by the orifices 24 and 26.

With continued reference to FIGS. 1-3, a sixth stream of water $F_6$ is shown being directed from a point between the exhaust manifold 16 and the cylinder head 14 and away from the engine. The magnitude of flow of the sixth stream of water $F_6$ is controlled by the orifice 32. The sixth stream of water $F_6$ removes heat from the exhaust manifold 16 and directs it away from the engine. It prevents this heat from affecting the temperatures of the cylinder head 14 or the block 12. Depending on the design of the engine, the configuration of the orifice 32 can be selected to remove the desired magnitude of heat from the exhaust manifold 16 that is necessary to allow the head 14 and block 12 to be maintained at certain preselected temperatures. It can therefore be seen in FIG. 3 that the quantity of water of the first stream of water $F_1$ is generally equal to the sum of the water of the second and sixth streams of water, $F_2$ and $F_6$.

With continued reference to FIGS. 1-3, certain other features of the engine are identified. In the exemplary engine shown in the Figures, four cylinders, 41-44, are provided. Each combustion chamber associated with the cylinders has a single exhaust port and a single intake port. The four exhaust ports, 61-64, and the four intake ports, 51-54, are cooled sequentially by the second stream of water $F_2$ and a third stream of water $F_3$, respectively. The exhaust ports, 61-64, are cooled by the second stream of water $F_2$ which then is divided into the third and fourth streams of water, $F_3$ and $F_4$. The third stream of water $F_3$ flows upwardly through the cylinder head 14 through a cooling jacket that is disposed in thermal communication with the intake ports, 51-54. The relative sizes of the orifices, 24 and 26, determine the amount of water that is directed upwardly with the third stream of water. It should be understood that the second and third streams of water, to some degree, both flow in thermal communication with both the intake ports and exhaust ports within the cylinder head 14 because of the close proximity of these various components. The second and third streams of water, $F_2$ and $F_3$, are separated from each other by a wall 70.

Several characteristics of the various embodiments of the present invention are shown in FIG. 3. They are enclosed within dashed line boxes. For example, dashed line box 72 encloses the orifice 32 and the resulting sixth stream of water $F_6$ which relates to one important characteristic of one of the preferred embodiments of the present invention. That characteristic is the removal of heat from the cooling system and the prevention of that heat from affecting the downstream portions of the engine, such as the cylinder head 14 and block 12. The heat removed through the sixth stream of water $F_6$ is discharged back to the body of water from which it was drawn by the pump 20. The amount of heat removed from the system is shown being governed by the size of orifice 32 in conjunction with the relative pressures within the cooling jacket of the exhaust manifold 16 and cylinder head 14. The water flowing through the sixth stream of water $F_6$ determines the amount of heat removed directly from the system. Dashed line box 74 is used to identify the wall 70 which separates the second and third streams of water, $F_2$ and $F_3$, and assists in reversing the direction of flow of the cooling water as it passes through the cylinder head 14. By dividing the overall flow of water into the head 14 into two streams, rather than a single stream, the velocity of the water in stream F2 is significantly increased. This increase in flow velocity is very helpful in view of the downward direction of the second stream of water $F_2$. Without an increase in the speed of the downward flowing stream, it could be possible for air bubbles or steam to remain within the cooling jacket associated with the exhaust ports, 61-64. Entrapped air within this cooling region of the cylinder head 14 could cause localized hot spots and result in damage to the engine. However, by dividing the flow with the wall 70, the speed of the second stream of water $F_2$ is significantly increased and this increased speed is sufficient to carry air bubbles with it downwardly toward the bottom end of the wall 70 and around the turn which reverses the direction of flow. Whether the air bubbles are then carried upwardly through the third stream of water $F_3$ or, alternatively, through orifice 24 into the bottom portion of the block 12, their entrapment within the cylinder head 14 is avoided. The third stream of water $F_3$, after it reverses direction at the bottom end of the wall 70, flows upwardly in thermal communication with the region of the cylinder head proximate the intake ports, 51-54, and then through orifice 26 to the block 12. The third stream of water flows into the cooling jacket of the block 12, but does not flow through a lengthy portion of that cooling jacket before passing out of the block 12 and through the thermostat 28. The fourth stream of water $F_4$, on the other hand, enters the block 12 at its bottom portion and flows upwardly in thermal communication with the walls of the cylinders, 41-44. Dashed line box 76 illustrates the feature of certain preferred embodiments of the present invention associated with the distribution of the third and fourth streams of water, $F_3$ and $F_4$, which distribute the water in a ratio that satisfies the cooling requirements of the intake ports, 51-54, and the cylinders, 41-44. The pressure differentials between the bottom and top regions of the cooling jacket within the block 12 and the sizes of the orifices, 24 and 26, are selected to share the cooling water between the cylinder walls and the intake ports.

With continued reference to FIGS. 1-3, another characteristic of the preferred embodiments of the present invention relates to the sequence of cooling of the various engine portions. The exhaust manifold 16 receives cooling water directly from the pump 20 and before the other portions of the engine. Then, the cylinder head 14 receives the cooling water which has already been directed through the exhaust manifold 16, but has not been diverted through orifice 32 and the sixth stream of water $F_6$. The water flowing into the cylinder head 14 flows in two different directions. First, it flows downwardly through the cylinder head in the second stream of water $F_2$. Then, a portion of the second stream of water is caused to reverse direction and flow upwardly in the third stream of water $F_3$ within the cylinder head 14 toward orifice 26. The other portion of the second stream of water $F_2$ is directed in the fourth stream of water $F_4$ through orifice 24 to the bottom portion of the cooling jacket of the block 12. The fourth stream of water $F_4$ provides the predominant share of the cooling of the cylinder walls, 41-44. The third and fourth streams of water are rejoined at the upper portion of the block 12 to flow through the thermostat 28 in the fifth stream of water $F_5$ and be directed away from the engine. As described above, certain embodiments of the present invention direct the fifth stream of water $F_5$ to flow in thermal communication with the oil sump 30 before being conducted overboard and back to the body of water from which it was drawn by the pump 20.

FIGS. 3 and 11 show two different embodiments of the present invention which share many similarities, but also have an important difference between their configurations. The embodiment shown in FIG. 3 provides the wall 70 which divides the flow of water through the cylinder head 14 into the second and third streams, $F_2$ and $F_3$, as determined by the sizes of the two orifices, 24 and 26. As described above, this split flow of water through the cylinder head 14 serves to increase the velocity of the second stream of water in order to avoid the entrapment of air or the accumulation of bubbles in the cooling jacket associated with the exhaust ports, 61-64. The embodiment shown in FIG. 11 does not split the flow of coolant through the cylinder head 14. Instead, it directs all of the coolant in a downward direction through the cooling passages of the cylinder head 14 and then divides the second stream of water into the third and fourth streams according to the sizes of the orifices, 24 and 26, with the third stream of water flowing through the fluid conducting portion 200 of the engine. As described above, the fluid conducting portion 200 can comprise several different components. An important characteristic of the embodiment shown in FIG. 11 is that it allows the water flowing in thermal communication with the cylinders, 41-44, to be controlled so that the cylinders are not overcooled. The water flowing in the third stream of water $F_3$ bypasses the cylinders and avoids the excess removal of heat which could otherwise disadvantageously result in condensation of fuel vapor and dilution of the oil within the engine. The primary purpose of the fluid conducting portion 200 is the avoidance of excessive cooling of the cylinder walls. Secondary advantages of this parallel third stream of water $F_3$ is the cooling of other components which are discussed above. This third stream of water which bypasses the cylinders, 41-44, is therefore made possible even though only one stream of water is directed through the cylinder head 14. The embodiment shown in FIG. 11 allows the system to avoid the overcooling of the cylinders, 41-44, without having to split the flow of coolant within the cylinder head 14. It does this by directing a partial flow of the coolant through the fluid conducting portion 200 rather than in the third stream of water shown in FIG. 3 flowing upwardly through the cylinder head 14 in thermal communication with the intake ports, 51-54.

Before describing the specific flow paths of the various streams of water through the cooling jackets of the engine, in conjunction with FIGS. 7-10, it will be helpful in understanding the beneficial features of the preferred embodiments of the present invention if the known characteristics of the prior art are described. Various known systems for cooling engines will be described below in conjunction with FIGS. 4-6. The cooling system schematically illustrated in FIG. 4 draws water from a body of water, with a pump 20, and directs that water to flow upwardly through a cooling jacket of a cylinder head 80, as represented by arrow 82. The cooling jacket of the cylinder head 80 is configured to cause the cooling water to flow in thermal communication with a plurality of exhaust ports 84 and intake ports 86. The water is then directed from the cylinder head 80, as represented by arrow 87, to a cooling jacket of an exhaust manifold 90, as represented by arrow 92. After the water flows downwardly through the exhaust manifold 90, it is directed to the bottom portion of an engine block 96, as indicated by arrow 94, where it flows upwardly through the cooling jacket of the engine block 96 in an upward direction and in thermal communication with a plurality of cylinders 98. From the upper portion of the engine block 96, the water is conducted through a thermostat 99 and back to a body of water from which it was drawn by the pump 20. FIG. 5 illustrates another known type of cooling system. Water drawn from a body of water is induced to flow upwardly through a cooling jacket of an exhaust manifold 90, as indicated by arrow 92 in FIG. 5, and then away from the exhaust manifold 90, as indicated by arrow 94, to the upper portion of a cylinder head 80. It flows downwardly, as represented by arrow 82, through the cooling jacket of the cylinder head 80 and in thermal communication with exhaust ports 84 and intake ports 86. Within the cooling system illustrated in FIG. 5, the water is then directed, as represented by arrow 87, to the bottom portion of the cylinder block 96 and upwardly through the cooling jacket of the cylinder block in thennal communication with the cylinders 98. The thermostat 99 controls the flow of water through the system illustrated in FIG. 5 and governs the flow of water back to the body of water from which it was drawn.

FIG. 6 illustrates a known engine cooling system that directs the water upwardly from the pump 20 through the cooling jacket of exhaust manifold 90 and then, along parallel paths, through a cylinder head 80 and engine block 96 as illustrated in FIG. 6. A thermostat 99 controls the flow of water through the system and back to the body of water. The parallel paths 100 direct the flow in thermal communication with the exhaust ports 84, intake ports 86, and cylinders 98. As can be seen in FIG. 6, the water flows in a generally upward direction through the engine block 96 and in thermal communication with the cylinders 98.

With continued reference to FIGS. 4-6, it should be understood that numerous configurations are known to those skilled in the art for conducting cooling water in thermal communication with the various heat emitting components of marine engines. In FIG. 4, the water is conducted sequentially through the cylinder head 80, exhaust manifold 90 and engine block 96. In FIG. 5, the water is conducted sequentially through the exhaust manifold 90, the cylinder head 80, and the engine block 96. In FIG. 6, the water is conducted sequentially through the exhaust manifold 90, the cylinder head, and the engine block 96, with the water being directed upwardly through the cooling jacket of the engine block 96 to cause it to flow serially in thermal communication with the walls of the cylinders 98 after flowing through parallel paths through the exhaust is manifold 90 and cylinder head 80. The various cooling systems known to those skilled in the art, of which three are illustrated in FIGS. 4-6, are directed toward various goals. Some of these goals are in conflict with other goals. As described above, it is important to avoid overheating of certain engine portions and it is also important to avoid overcooling other portions. As an example, the removal of heat from the exhaust manifold of an engine is extremely important because of the intense heat that can be absorbed by the exhaust manifold from the exhaust gases created in the combustion chambers of the engine. Similarly, it is important to remove heat from the cylinder head of the engine, primarily from the portion of the cylinder head surrounding the exhaust ports. This region of the cylinder head conducts the exhaust gases from the combustion chambers to the exhaust manifold.

Other portions of the engine structure are less critical with regard to the need for the rapid removal of heat. Some portions of the engine structure emit heat at a slower rate and care must be taken to avoid the overcooling of those regions, particularly in view of the fact that water drawn from a body of water can possibly be at a temperature only slightly above freezing. If this extremely cold water is caused to flow directly in thermal contact with the cylinder walls of the engine, the temperature of those cylinder walls may be reduced to a magnitude that is sufficiently low to cause condensation of fuel vapor on the walls in regions where the pistons can wipe that condensate into the pools of lubricant where the condensed fuel can dilute the oil within the sump of the engine. Naturally, this condition can lead to serious degradation of the lubricant and significant harm to the engine. Therefore, it is important that the overcooling of the cylinders be avoided. In view of the need to avoid the overheating of certain regions of the engine and the overcooling of other regions, it is critically important that the temperature management of the cooling system be carefully controlled to satisfy these competing and often mutually exclusive goals. To address these competing goals, the order or sequence of cooling of the various regions of the engine is important. In addition, it is important to remove heat from certain regions of the engine in a manner that prevents that heat from affecting downstream portions. Therefore, merely controlling the sequence of coolant flow is often insufficient to meet all of these conflicting cooling goals. It is also important to control the direction of coolant through the various portions of the engine in order to properly manage the way in which the water flows through the cooling jackets and maintains the various portions of the cooling jackets in a continuously filled condition. In doing so, it is important to avoid the collection of air bubbles or pockets that might otherwise create hot spots and damage parts of the engine. To accomplish this, it is therefore necessary to control the speed or flow velocity of the coolant as it passes through various sections of the engine.

The basic configuration of the preferred embodiment of the present invention was described above in conjunction with the schematic illustration of FIG. 3. An alternative embodiment of the present invention was described above in conjunction with FIG. 11. The overall structure of the preferred embodiments of the present invention was described above in conjunction with the isometric illustration in FIG. 1 and the exploded view illustrated in FIG. 2. FIGS. 7-10 illustrate section views taken through portions of the engine shown in FIGS. 1 and 2.

FIG. 7 is a section view of the exhaust manifold 16 showing the water passages to which the first stream of water $F_1$ is conducted. The arrows illustrated in FIG. 7 show the path of the first stream of water $F_1$ through the exhaust manifold. Some of those arrows are specifically identified by reference letters $F_1$. The first stream of water exists from the exhaust manifold 16 in a direction into the page of FIG. 7 at the upper portion of the exhaust manifold which is identified by reference numeral 110 in FIGS. 1, 2 and 7. Exhaust gas flows through the exhaust manifold 16 along the path represented by the block arrows E and passes into the exhaust manifold through the openings identified by reference numerals 112.

FIG. 8 is a section view taken through the cylinder head 14 at the location represented by dashed line 108 in FIG. 2 and FIG. 9 is a section view of the cylinder head 14 taken at the location represented by dashed line 109 in FIG. 2. Both of the sections, shown in FIGS. 8 and 9, are generally horizontal sections taken in FIG. 2 and viewed in a downward direction. In FIG. 8, the section is taken through the uppermost combustion chamber 122 to show the exhaust port 61 which is also identified in FIG. 3. A valve guide 124 aligns the reciprocal motion of an associated exhaust valve (not shown in FIG. 8) to open and close the exhaust port 61. Exhaust gas travels along the path represented by block arrow E in FIG. 8. Several portions of the cooling jackets for both the second and third streams of water, $F_2$ and $F_3$, are shown in FIG. 8. It should be understood that the shapes and directions of the first and second streams of water are very irregular and the section view of FIG. 8 cuts through both of the passages which are located in the regions identified by reference numerals 21 and 22 in FIG. 3. It should also be understood that the dividing wall 70 in FIG. 3, which is shown in an exemplary regular rectangular shape in FIG. 3 is actually highly irregular and shaped to control the flows of the second and third streams of water around the various components and cavities contained within the cylinder head 14. The flat face identified by reference numeral 130 in FIG. 8 is also identified in FIG. 2 and is the mating surface against which the exhaust manifold 16 is attached with a gasket between them.

FIG. 9 is a section view taken through the same combustion chamber 122 as FIG. 8, but at a location which cuts through the uppermost intake port 51. Block arrow A represents the direction of flow of air into the combustion chamber 122 and reference numeral 128 identifies a valve guide for an intake valve (not shown in FIG. 9). Portions of the cooling jackets which conduct the second and third streams of water, $F_2$ and $F_3$, are shown in FIG. 9. Again, these cooling passages are separated by a wall 70 that is illustrated and identified in FIG. 3 as a uniform rectangular cross-sectional wall, but is actually highly irregular in shape and configured to separate these cooling passages as they pass in thermal communication with the various regions and components of the cylinder head 14.

The surface identified by reference numeral 140 in FIGS. 8 and 9 is also identified in FIG. 2 and is the surface which is disposed in contact with a corresponding surface of the engine block 12 with a gasket therebetween. The depressions identified by reference numerals 142 in FIGS. 8 and 9 are also identified in FIG. 2 to represent the crescent-shaped cooling passage that conducts the cooling water in thermal communication with the cylinders 41-44 as described above in conjunction with FIG. 3. Similarly, reference numeral 144 identifies depressions in FIGS. 8 and 9 which are the crescent-shaped cooling passages shown in FIG. 2 which conduct cooling water through the engine block 12 in thermal communication with the cylinders, 41-44, as described above in conjunction with FIG. 3.

FIG. 10 shows an end view of the engine block 12 viewed in a direction looking from the cylinder head 14. The fourth stream of water $F_4$ enters the cooling jacket that surrounds the cylinders, 41-44, and travels in an upward to direction. The fourth stream of water $F_4$ enters the cooling jacket shown in FIG. 10 at the location identified by reference numeral 150. This fourth stream of water travels upwardly toward the point identified by reference numeral 152 in FIG. 10. It then joins with the third stream of water $F_3$ and flows toward and through the thermostat 28 as illustrate in FIG. 3. With reference to FIGS. 2, 3 and 10, the fourth stream of water $F_4$ is shown entering the engine block 12, through the crescent-shaped channels illustrated in FIG. 2 after passing through the orifice 24 identified in FIG. 3. This fourth stream of water fills the cooling jacket surrounding the cylinders, 41-44, and joins the third stream of water $F_3$ at the upper end of the cooling jacket within the engine block 12. The third stream of water enters the engine block 12 after passing through the orifice 26. The third and fourth streams of water are joined and they pass through the thermostat 28 at the upper end of the engine block 12 as identified in FIG. 2 and schematically represented in FIG. 3.

With continued reference to FIGS. 1-3 and 7-11, the various preferred embodiments of the present invention are described in terms of the methods involving the various streams of water that are directed through cooling passages of the engine system. As an example, in some preferred embodiments of the present invention, its method comprises the steps of pumping a first stream of water $F_1$ from a body of water in which the marine propulsion system is operated. The pumping is done by a pump 20 as shown in the figures. The methods also comprise the steps of directing the first stream of water $F_1$ through the cooling jacket of the exhaust manifold 16, directing a second stream of the water $F_2$ through a first portion 21 of the head 14 of the engine and directing a third stream of the water $F_3$ through a second portion of the head 22 wherein the first portion of the head of the engine comprises the cooling jacket of the exhaust ports and the second portion of the head comprises a cooling jacket for the intake ports. The methods further comprise the step of directing a fourth stream of water $F_4$ through a block 12 of the engine. The rate of flow of the second stream of water $F_2$ is controlled as a function of the temperature of the fourth stream of water $F_4$, as accomplished by the thermostat 28. The second stream of water $F_2$ is directed downwardly through the first portion 21 of the head 14, the third stream of water $F_3$ is directed upwardly through the second portion 22 of the head, the fourth stream of water $F_4$ is directed upwardly through the block 12 of the engine and the third and fourth streams, $F_3$ and $F_4$, are drawn from the second stream $F_2$. In certain preferred embodiments of the present invention, the second stream of water $F_2$ is less than the first stream of water $F_1$. In other preferred embodiments of the present invention, a sixth stream of the water $F_6$ is conducted away from the exhaust manifold 16 and prevented from flowing into the head of the engine 14, wherein the first stream of water $F_1$ is greater than the second stream of water $F_2$ as a result of the sixth stream of water $F_6$ being controlled by providing an outlet conduit 160 that is configured to conduct a preselected rate of flow of the sixth stream of water which is controlled as a function of operating pressures of the water within the cooling jacket of the exhaust manifold 16. This sixth stream of water removes heat that was emitted by the exhaust manifold and absorbed by the sixth stream of water. The various preferred embodiments of the present invention have certain advantageous characteristics that allow the streams of water to selectively remove heat from specified portions of the engine while avoiding the overcooling of other portions. As an example, the sixth stream of water removes heat from the exhaust manifold and prevents that heat from affecting the temperatures of downstream components, such as the cylinder head 14 and engine block 12. A dividing wall separates the cooling passages of the cylinder head into two cooling jackets that conduct the second and third streams of water, $F_2$ and $F_3$, in proportions that provide preselected rates of cooling for the exhaust ports, 61-64, and intake ports, 51-54. The third stream of water $F_3$ flowing in thermal communication with the intake ports is less than the water flowing in thermal communication with the exhaust ports because of the cooperative action of the orifices, 24 and 26, which determine the relative rates of flow of the third and fourth streams of water, $F_3$ and $F_4$. The dividing wall 70 between the two cooling passages of the cylinder head 14 increases the flow rate of the second stream of water $F_2$ in a manner which avoids the accumulation of air pockets or bubbles within the first portion of the cooling jacket within the cylinder head that could otherwise result from the fact that the flow of water through this portion of the cylinder head is in a downward direction. The accumulation of air pockets in the second portion 22 of the cooling jacket in the cylinder head 14 is less likely because of the upward direction of flow of the cooling water within the third stream of water $F_3$. This is also true with regard to the fourth stream of water $F_4$ flowing upwardly through the cooling jacket of the engine block 12. The rates of flow of the various streams of water can be preselected through the configuration of the various orifices, 24, 26, and 32, that are provided in various locations within the engine cooling system. As described above, the alternative embodiment illustrated in FIG. 11 is somewhat similar to the embodiment shown in FIG. 3, but differs from that embodiment in two important ways. First, the embodiment shown in FIG. 11 does not provide a split flow through the cylinder head, such as that which results because of the wall 70 which creates the second and third streams of water, $F_2$ and $F_3$, within the cylinder head 14. Instead, it provides a single downwardly directed second stream of water $F_2$ through the cylinder head and a flow of water parallel with the fourth stream of water flowing upwardly through the engine block 12. The third stream of water flows through the fluid conducting portion 200 of the engine. Both of these two alternative embodiments, shown in FIGS. 3 and 11, accomplish the goal of avoiding the flow of too much cooling water through the engine block 12 by directing the third stream of water $F_3$ around the cooling passages that are in thermal communication with the cylinders, 41-44.

Although the various embodiments of the present invention have been described in particular detail and illustrated with specificity, it should be understood that alternative embodiments are also within its scope.

What is claimed is:

1. A method for cooling an engine of a marine propulsion system, the method comprising:

pumping water from a body of water in which the marine propulsion system is operating;

pumping the water through the engine and then back to the body of water;

directing the water through a cooling jacket of an exhaust manifold of the engine, through a head of the engine, and then through a block of the engine;

directing the water through the head of the engine via an exhaust port cooling jacket disposed in thermal communication with a plurality of exhaust ports in the head of the engine; and directing the water into an upper portion of the head of the engine and then downwardly in the exhaust port cooling jacket so as to sequentially cool the exhaust ports in the plurality as the water moves downwardly in the exhaust port cooling jacket;

directing the water from the exhaust port cooling jacket into an intake port cooling jacket that is separated from the exhaust port cooling jacket by a wall and disposed in thermal communication with a plurality of intake ports in the head of the engine; and directing the water into a lower portion of the head of the engine and then reversely directing the water upwardly in the intake port cooling jacket to thereby sequentially cool the intake ports in the plurality as the water moves upwardly in the intake port cooling jacket.

2. The method according to claim 1, comprising dividing the water that is directed into the upper portion of the head of the engine into two parallel streams that both are directed downwardly in the exhaust port cooling jacket and sequentially cool the exhaust ports in the plurality as the water moves downwardly in the exhaust port cooling jacket.

3. The method according to claim 1, comprising dividing the water that is directed into the lower portion of the head into two parallel streams that both are directed upwardly in the intake port cooling jacket and sequentially cool the intake ports in the plurality as the water moves upwardly in the exhaust port cooling jacket.

4. A method for cooling an engine of a marine propulsion system, the method comprising:

pumping water from a body of water in which the marine propulsion system is operating;

pumping the water through the engine and then back to the body of water;

directing the water through a cooling jacket of an exhaust manifold of the engine, through a head of the engine, and then through a block of the engine;

directing the water through the head of the engine via an exhaust port cooling jacket disposed in thermal communication with a plurality of exhaust ports in the head of the engine; and directing the water into an upper portion of the head of the engine and then downwardly in the exhaust port cooling jacket so as to sequential cool the exhaust ports in the plurality as the water moves downwardly in the exhaust port cooling jacket; and dividing the water that has been directed through the head of the engine into separate first and second streams, and directing the first stream through the block of the engine so as to sequentially cool a plurality of cylinders in the block and directing the second stream through the head of the engine so as to sequentially cool a plurality of intake ports in the head of the engine and bypass at least a portion of the block so that the second stream does not cool at least one cylinder in the plurality of cylinders.

5. A method for cooling an engine of a marine propulsion system, the method comprising:

pumping water from a body of water in which the marine propulsion system is operating;

pumping the water through the engine and then back to the body of water;

directing the water through a cooling jacket of an exhaust manifold of the engine, through a head of the engine, and then through a block of the engine;

directing the water through the head of the engine via an exhaust port cooling jacket disposed in thermal communication with a plurality of exhaust ports in the head of the engine; and directing the water into an upper portion of the head of the engine and then downwardly in the exhaust port cooling jacket so as to sequentially cool the exhaust ports in the plurality as the water moves downwardly in the exhaust port cooling jacket;

dividing the water that has been directed through the exhaust port cooling jacket in the head of the engine into separate first and second streams, and directing the first stream through the block of the engine so as to sequentially cool a plurality of cylinders in the block and directing the second stream through an intake port cooling jacket in the head of the engine so as to sequentially cool a plurality of intake ports in the head of the engine and bypass at least a portion of the block so that the second stream does not cool at least one cylinder in the plurality of cylinders;

directing the first stream into a lower portion of the block and then upwardly in the block; and directing the second stream into an upper portion of the block.

6. The method according to claim 5, comprising joining the first and second streams in the upper portion of the block.

7. The method according to claim 5, comprising directing the second stream of water intermediate the head and the block through a fluid conducting portion of the engine which is not part of the head of the engine.

8. The method according to claim 7, wherein the fluid conducting portion of the engine is selected from the group consisting of a main oil gallery water jacket, a bed plate cooling passage, and a combustion chamber.

9. A method for cooling an engine of a marine propulsion system, the method comprising:

pumping water from a body of water in which the marine propulsion system is operating;

pumping the water through the engine and then back to the body of water;

directing the water through a cooling jacket of an exhaust manifold of the engine, through a head of the engine, and then through a block of the engine;

directing the water through the head of the engine via an exhaust port cooling jacket disposed in thermal communication with a plurality of exhaust ports in the head of the engine; and directing the water into an upper portion of the head of the engine and then downwardly in the exhaust port cooling jacket so as to sequentially cool the exhaust ports in the plurality as the water moves downwardly in the exhaust port cooling jacket;

dividing the water that has been directed through the exhaust port cooling jacket in the head of the engine into separate first and second streams, and directing the first stream through an intake port cooling jacket in the block of the engine so as to sequentially cool a plurality of cylinders in the block and directing the second stream through the head of the engine so as to sequentially cool a plurality of intake ports in the head of the engine and bypass at least a portion of the block so that the second stream does not cool at least one cylinder in the plurality of cylinders;

directing the first stream into a lower portion of the block and then upwardly in the block;

directing the second stream into an upper portion of the block;

wherein the first stream of water flows through a first passageway between the head and the block, the first passageway having a first orifice that restricts flow through the passageway, wherein the second stream of water flows through a second passageway between the head and the block, the second passageway having a second orifice that restricts flow through the passageway;

identifying rates of flow of the first and second streams of water that effectively maintain the block of engine at a selected temperature; and sizing the first and second orifices to thereby achieve the preselected rates of flow of said first and second streams of water, respectively, and thereby maintain the block of the engine at the selected temperature.

10. The method according to claim 9, comprising directing the combined first and second streams of water through a thermostat.

11. A method for cooling an engine of a marine propulsion system, the method comprising:

pumping water from a body of water in which the marine propulsion system is operating;

pumping the water through the engine and then back to the body of water;

directing the water through a cooling jacket of an exhaust manifold of the engine, through a head of the engine, and then through a block of the engine;

directing the water through the head of the engine via an exhaust port cooling jacket disposed in thermal communication with a plurality of exhaust ports in the head of the engine;

directing the water into an upper portion of the head of the engine and then downwardly in the exhaust port cooling jacket so as to sequentially cool the exhaust ports in the plurality as the water moves downwardly in the exhaust port cooling jacket;

diverting a portion of the water away from the engine so that the portion of water removes heat from the exhaust manifold without allowing said heat to raise the temperature of the head of the engine and block of the engine;

wherein said diverted portion of water is diverted away from the engine via an open passageway having an orifice that restricts flow through the passageway;

identifying a magnitude of heat to be removed from the exhaust manifold in order to allow the head and block of the engine to be maintained at a selected temperature;

selecting a rate of flow of the diverted portion of water as a function of the operating pressure of the water in the cooling jacket of the exhaust manifold to thereby remove the identified magnitude of heat from the exhaust manifold; and sizing the orifice to thereby achieve the preselected rate of flow of said diverted portion of water.

12. The method according to claim 11, wherein the magnitude of heat removed from the exhaust manifold is a function of the restriction provided by the orifice and relative pressures within the cooling jacket of the exhaust manifold and the cylinder head.

13. The method according to claim 11, comprising discharging the diverted portion of water back to the body of water.

14. The method according to claim 11, wherein the quantity of the water directed through the cooling jacket of the exhaust manifold is substantially equal to the combined quantity of water in the head and the passageway.

15. The method according to claim 11, comprising directing the water upwardly through the cooling jacket of the exhaust manifold.

* * * * *